US006065987A

United States Patent [19]

Bigotto

[11] Patent Number: 6,065,987

[45] Date of Patent: May 23, 2000

[54] ELECTRICAL TERMINAL

[75] Inventor: Pier Carlo Bigotto, Rivoli, Italy

[73] Assignee: Framatome Connectors International, Courbevoie, France

[21] Appl. No.: 09/196,710

[22] Filed: Nov. 20, 1998

[30] Foreign Application Priority Data

Nov. 21, 1997 [IT] Italy ..... TO97A1023

[51] Int. Cl.[7] ..... H01R 13/28

[52] U.S. Cl. ..... 439/290; 439/284

[58] Field of Search ..... 439/290, 284

[56] References Cited

U.S. PATENT DOCUMENTS

| | | | |
|---|---|---|---|
| 453,225 | 2/1891 | Wheeler | 439/284 |
| 2,335,843 | 11/1943 | Rogoff | 439/287 |
| 2,434,226 | 1/1948 | Reyolds | 439/290 |
| 4,564,259 | 1/1986 | Vandame | 439/290 |
| 5,108,304 | 4/1992 | Bogiel et al. | 439/290 |

FOREIGN PATENT DOCUMENTS 0 681 345 A1 11/1995 European Pat. Off. .

*Primary Examiner*—Renee S. Luebke
*Assistant Examiner*—T C Patel
*Attorney, Agent, or Firm*—Perman & Green, LLP

[57] ABSTRACT

A hermaphroditic electric terminal (1) having a connection portion (6) for connection to an electric cable (7), and a contact portion (8) cooperating with a contact portion of an identical terminal; the contact portion (8) having a rigid half-shell-shaped contact element (20) and an elastic contact blade (21), both extending substantially parallel to the connection direction (A) of the terminal; and the elastic contact blade (21) facing the concavity of the half-shell-shaped contact element (20).

13 Claims, 3 Drawing Sheets

ELECTRICAL TERMINAL

FIELD OF THE INVENTION

The present invention relates to a hermaphroditic electric terminal for an electric connector.

BACKGROUND OF THE INVENTION

Hermaphroditic electric terminals are known which substantially comprise a connection portion for connection to an electric cable; and a contact portion which cooperates, in use, with the contact portion of an identical terminal.

The contact portion normally comprises two contact blades extending substantially in the connection direction of the terminal and facing each other so that, when the terminal is connected to an identical terminal, one of the contact blades of each terminal is interposed between the two contact blades of the other terminal.

A drawback of known terminals of the type briefly described above lies in the contact blades being exposed and therefore subject to impact and deformation.

By way of a solution, electric terminals have been proposed in which the contact blade is substantially housed inside a box structure, as illustrated, for example, in EP-A-O 681 345 and U.S. Pat. No. 4,564,259.

Such terminals, however, are complex and expensive in design, and, once connected to an identical terminal, define a connecting unit of a width much greater than that of a single terminal.

It is an object of the present invention to provide a hermaphroditic electric terminal designed to eliminate the drawbacks typically associated with known terminals.

According to the present invention, there is provided an electric terminal as claimed in claim 1.

BRIEF DESCRIPTION OF THE DRAWINGS

A preferred, non-limiting embodiment of the present invention will be described by way of example with reference to the accompanying drawings, in which.

DETAILED DESCRIPTION OF THE PRESENT INVENTION

Figure 1:
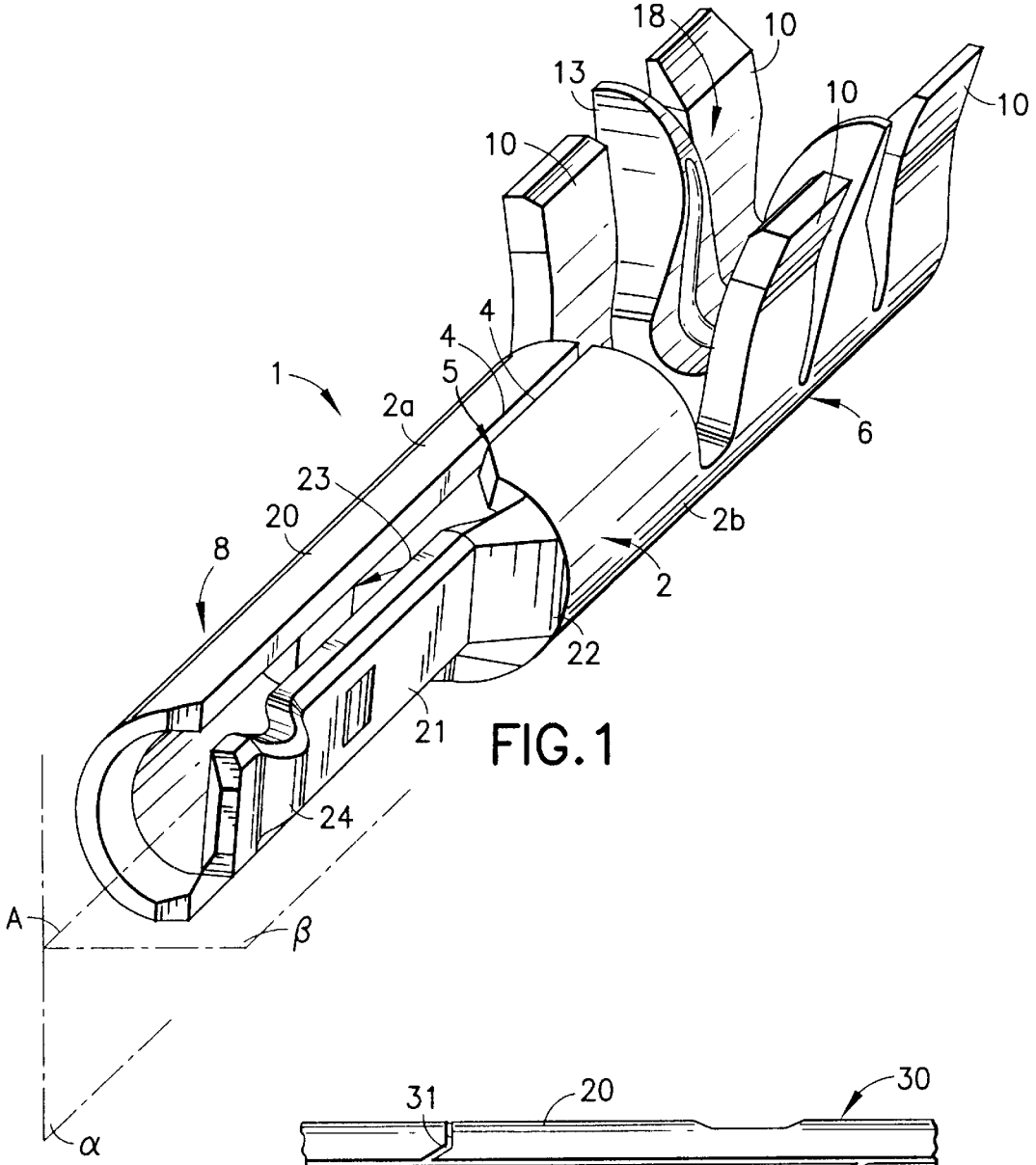
FIG. 1 shows a view in perspective of a hermaphroditic electric terminal in accordance with the teachings of the present invention.
Figure 2:
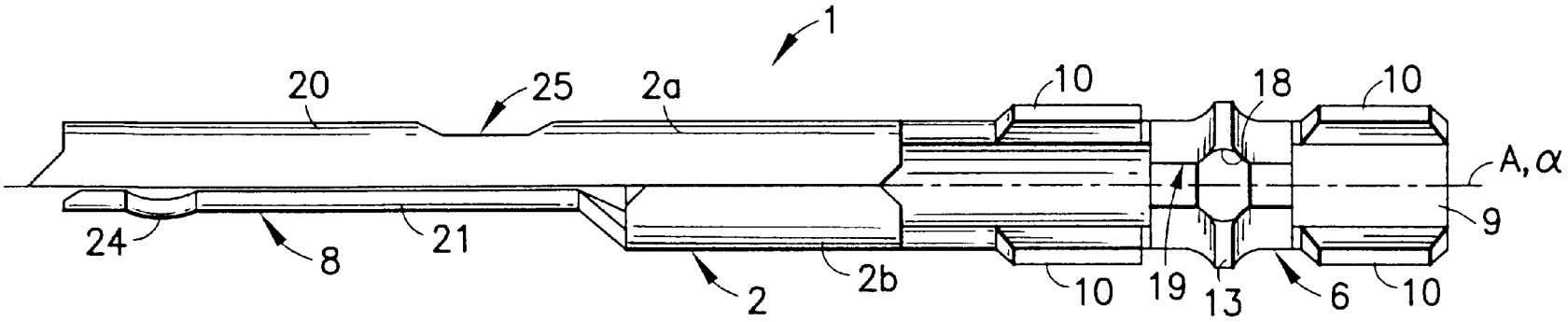
FIG. 2 shows a plan view of the FIG. 1 terminal.
Figure 3:
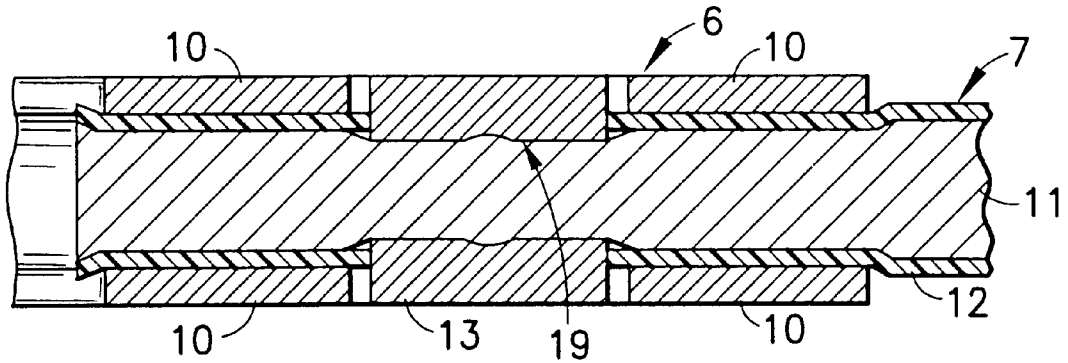
FIG. 3 shows a partial section of the terminal connected to a respective electric cable.

With reference to FIGS. 1 to 3, number 1 indicates as a whole a hermaphroditic electric terminal for an electric connector (not shown). Terminal 1 is formed in one piece from conductive sheet metal by means of blanking and pressing operations.

Figure 4:
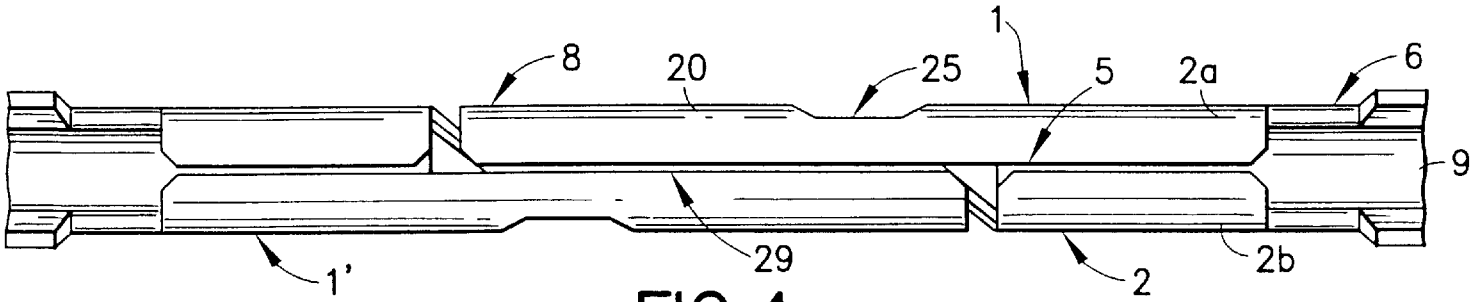
FIG. 4 shows a plan view of a pair of mutually connected terminals according to the invention.
Figure 5A:
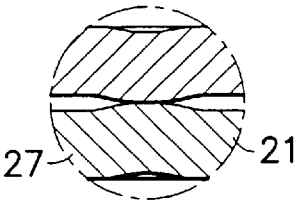
FIG. 5A is a detail cross section view which is an enlargement of circled region 5A in FIG. 5.
Figure 5:
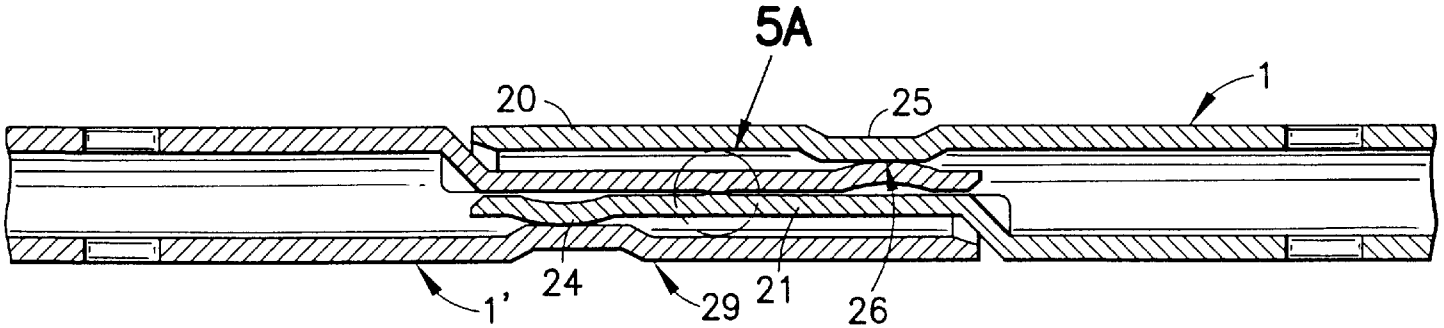
FIG. 5 shows a longitudinal half section of the FIG. 4 terminals.

Terminal 1 is elongated along a respective axis A defining, in use, the connection direction of the terminal, and comprises, integrally, a substantially cylindrical intermediate portion 2 of axis A, a connection portion 6 for connection to an electric cable 7 (FIG. 3), and a contact portion 8 which cooperates, in use, with the contact portion of an identical electric terminal indicated 1' in FIGS. 4 and 5.

Intermediate portion 2 is defined by a wall formed into a cylinder so that adjacent opposite longitudinal edges 4 of the wall form a narrow gap 5. Connection portion 6 and contact portion 8 extend axially from opposite ends of intermediate portion 2.

More specifically, connection portion 6 comprises a substantially semicylindrical bottom wall 9 of axis A, which axially prolongs a sector of intermediate portion 2 on the opposite side to gap 5.

Connection portion 6 is symmetrical with respect to a mid plane $\alpha$ containing axis A and extending along gap 5, and is open on the same side as gap 5.

Connection portion 6 comprises pairs of tabs 10 extending, substantially tangentially with respect to bottom wall 9, from respective opposite longitudinal edges of wall 9, and which are permanently deformable to grip cable 7.

Cable 7 comprises, in known manner, an inner conductor 11, and an outer insulating sheath 12.

The connection portion is a so-called IDC (insulation displacement contact) type, and comprises, integrally, a substantially U-shaped knife element 13 symmetrical with respect to plane $\alpha$, interposed axially between pairs of tabs 10, and defining an opening 18 facing the opening of bottom wall 9.

Opening 18 defines a passage 19 smaller than the outside diameter of cable 7, so that knife element 13 cuts sheath 12 of the cable, when the cable is inserted inside connection portion 6, and establishes electrical contact with conductor 11 (FIG. 3).

Contact portion 8 substantially comprises a contact element 20 in the form of a half-shell; and an elastic contact blade 21 facing contact element 20.

More specifically, contact element 20 is substantially semicylindrical, constitutes an axial extension of a lateral sector 2*a* of intermediate portion 2 adjacent to gap 5, and, being semicircular in section, is substantially rigid.

Blade 21 projects substantially axially from an opposite lateral sector 2*b* of intermediate portion 2, and is connected integrally to intermediate portion 2 by a connecting portion 22 sloping towards contact element 20. Contact element 20 and blade 21 are symmetrical with respect to a plane $\beta$ (FIG. 1) perpendicular to the plane of symmetry $\alpha$ of intermediate portion 2 and connection portion 6.

Blade 21 extends substantially along a plane parallel to plane $\alpha$, faces the concavity of contact element 20, is of a width smaller than the inside diameter of contact element 20, and is conveniently located close to the longitudinal opening 23 of contact element 20 and within the transverse dimension of intermediate portion 2.

Blade 21 comprises a boss 24 projecting away from contact element 20 to define a first contact point of terminal 1; and, close to intermediate portion 2, contact element 20 comprises an impression 25 projecting inwards of terminal 1 and having a flat surface 26, which is relatively extensive axially and defines a second contact point of terminal 1.

Blade 21 also comprises an intermediate impression 27 (FIG. 5) projecting slightly towards contact element 20, and which defines a third contact point of terminal 1.

FIGS. 4 and 5 show terminal 1 in the mated position with identical terminal 1'; which mated position is achieved by placing the terminals coaxial with each other, with planes α and β in common, and with the terminals rotated 180° with respect to each other and with respect to an axis perpendicular to plane β, so that respective contact portions 8 are positioned facing each other end to end.

When terminals 1 and 1' are brought together axially, blade 21 of each terminal 1, 1' is inserted between contact element 20 and blade 21 of the other terminal 1', 1, and the two contact elements 20 are placed side by side to form a substantially rigid cylindrical casing 29 fully enclosing and protecting blades 21.

The electric connection between the two terminals is substantially defined by boss 24 of each blade 21 contacting surface 26 of contact element 20 of the other terminal. Impressions 27 defining the third point of contact cooperate with each other substantially to exert a small amount of elastic pressure on blades 21 to ensure sufficient contact pressure between each blade 21 and contact element 20 of the other terminal.

Figure 6:
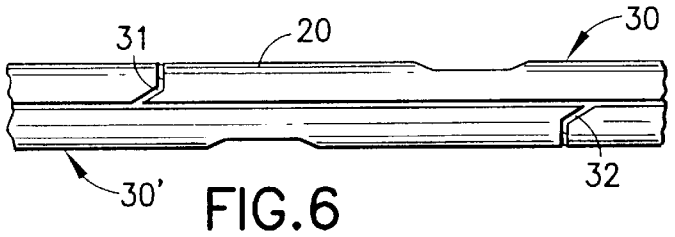
FIG. 6 shows a partial side view of a pair of mutually connected terminals according to a variation of the invention.

FIG. 6 shows a terminal 30 according to a variation of the invention and connected to an identical terminal 30'.

Terminal 30 only differs from terminal 1 described above by comprising two end projections 31 at the free edges of contact element 20. Projections 31 are substantially triangular and extend axially to form tapered extensions of the respective lateral edges of element 20.

In use, projections 31 engage respective complementary seats 32 formed in intermediate portion 2 to prevent the elastic action of blades 21—each facing contact element 20 of the complementary terminal—from offsetting terminals 30, 30', and in particular from parting contact elements 20.

The advantages of terminal 1 according to the teachings of the present invention will be clear from the foregoing description.

In use, contact element 20 forms, with contact element 20 of an identical terminal 1', a substantially rigid shell for housing and protecting blades 21. Moreover, this is achieved by means of a straightforward, inexpensive structure, and the transverse size of the connecting unit defined by the two connected terminals is substantially equal to that of each individual terminal.

Even when free, i.e. prior to insertion inside the respective cavity of the connector, the terminal provides for safely protecting blade 21 by this being located close to the longitudinal opening of contact element 20 and inwards with respect to intermediate portion 2, thus reducing the risk of accidental impact and deformation of blade 21 when handling the terminal.

Finally, the substantially cylindrical shape of the terminal provides for good mechanical strength combined with highly compact transverse dimensions, thus enabling the terminal to used in closely spaced multiway connectors.

Clearly, changes may be made to terminals 1, 30 as described and illustrated herein without, however, departing from the scope of the present invention.

In particular, connection portion 6 for connection to electric cable 7 may be formed in any other way.

What is claimed is:

1. A hermaphroditic electrical terminal (1, 30) comprising a connection portion (6) connectable to an electric cable (7), and a contact portion (8) cooperating with the contact portion of an identical terminal (1', 30'); said contact portion (8) comprising a substantially rigid contact element (20), and an elastic contact blade (21) extending in a direction substantially parallel to a mating direction (A) of the terminal (1, 30); characterized in that said substantially rigid contact element is defined by a half-shell portion (20) having a longitudinal opening (23); said elastic contact blade (21) is mainly a flat contact element facing a concavity of said half-shell portion (20) and being located close to said longitudinal opening (23).

2. A terminal as claimed in claim 1, comprising a substantially tubular intermediate portion (2) interposed between said connection portion (6) and said contact portion (8).

3. A terminal as claimed in claim 2, wherein said half-shell portion (20) constitutes an axial extension of a sector (2*a*) of said intermediate portion.

4. A terminal as claimed in claim 2 wherein said elastic contact blade (21) is narrower than said half-shell portion (20), and extends with a portion of said intermediate portion (2) in a direction generally transverse to said connection direction.

5. A terminal as claimed in claim 2, wherein said elastic contact blade (21) defines a first contact point (24) facing away from said half-shell portion (20); and in that said half-shell portion (20) defines a second contact point (26) facing said elastic contact blade (21).

6. A terminal as claimed in claim 5, wherein said first contact point (24) is located close to a free end of said elastic contact blade (21); and in that said second contact point (26) is located close to said intermediate portion (2).

7. A terminal as claimed in claim 1, wherein said elastic contact blade (21) comprises an intermediate impression (27) projecting towards said half-shell portion (20).

8. A terminal as claimed in claim 1, wherein said half-shell portion (20) is semicylindrical.

9. A terminal as claimed in claim 1, wherein said intermediate portion (2) is substantially cylindrical.

10. A terminal as claimed in claim 2, wherein said half-shell portion (20) has at least one end projection (31); and in that said intermediate portion (2) comprises a corresponding seat (32); said projection (31) cooperating with said seat of an identical terminal (1', 30'), in a mating position, to prevent misalignment of the terminals (1, 1', 30, 30') by the elastic contact forces.

11. An electrical connecting unit defined by a pair of hermaphroditic electric terminals (1, 1'; 30, 30'), each comprising a connection portion (6) connectable to an electric cable (7), and a contact portion (8) cooperating with the contact portion of an identical terminal (1', 30'); said contact portion (8) comprising a substantially rigid contact element (20), and an elastic contact blade (21) extending in a direction substantially parallel to a mating direction (A) of the terminal (1, 30); characterized in that said substantially rigid contact element of each said terminal (1, 1'; 30, 30') is defined by a half-shell portion having a longitudinal opening (23); said elastic contact blade (21) being substantially a flat contact element facing a concavity of said half-shell portion (20), and being located close to said longitudinal opening (23); said half-shell portions (20) of said terminals (1, 1'; 30, 30') cooperating with each other to define, in a mating position of the terminals (1, 1', 30, 30'), a tubular casing (29) housing said elastic contact blades (21).

12. A connecting unit as claimed in claim 11, wherein said terminals (1, 1'; 30, 30') each comprise a substantially tubular intermediate portion (2) interposed between said connection portion (6) and said contact portion (8).

13. A connecting unit as claimed in claim 11, characterized in that said tubular casing (29) and said intermediate portions (2) of said terminals (1, 1'; 30, 30') are cylindrical and have the same diameters, so as to define as a whole a substantially continuous cylindrical shape of a transverse dimension equal to the transverse dimension of each said terminal (1, 1'; 30, 30').

* * * * *